US006770580B2

(12) United States Patent
Bevans

(10) Patent No.: US 6,770,580 B2
(45) Date of Patent: Aug. 3, 2004

(54) FABRIC MATERIAL CONSTRUCTED FROM OPEN-SIDED FIBERS FOR USE IN GARMENTS AND THE LIKE

(75) Inventor: Russ Bevans, Lafayette, CO (US)

(73) Assignee: GoLite, Boulder, CO (US)

( * ) Notice: Subject to any disclaimer, the term of this patent is extended or adjusted under 35 U.S.C. 154(b) by 225 days.

(21) Appl. No.: 09/924,974

(22) Filed: Aug. 8, 2001

(65) Prior Publication Data

US 2003/0032354 A1 Feb. 13, 2003

(51) Int. Cl.[7] ..... D03D 15/00

(52) U.S. Cl. ..... 442/194; 442/304; 442/308; 442/309; 442/312; 442/335; 442/338; 428/358; 428/365; 428/397; 428/398

(58) Field of Search ..... 442/194, 304, 442/308, 309, 312, 335, 338; 428/358, 365, 397, 398

(56) References Cited

U.S. PATENT DOCUMENTS

| | | | | | |
|---|---|---|---|---|---|
| 2,945,739 | A | * | 7/1960 | Lehmicke | 264/177.17 |
| 3,984,515 | A | * | 10/1976 | Mommaerts et al. | 428/394 |
| 4,195,364 | A | * | 4/1980 | Bengtsson et al. | 2/81 |
| 4,201,813 | A | * | 5/1980 | Brumlik | 428/97 |
| 4,361,617 | A | * | 11/1982 | Suzuki et al. | 442/194 |
| 5,458,963 | A | * | 10/1995 | Meirowitz et al. | 442/337 |
| 5,547,733 | A | * | 8/1996 | Rock et al. | 428/91 |
| 6,509,285 | B1 | * | 1/2003 | Yeh | 442/195 |

* cited by examiner

*Primary Examiner*—Elizabeth M. Cole
*Assistant Examiner*—Norca L. Torres
(74) *Attorney, Agent, or Firm*—Emery L. Tracy

(57) ABSTRACT

A fabric material for forming a garment to be worn by a user is provided. The fabric material has a first side and a second side. The fabric material comprises a plurality of fibers with at least a portion of the fibers having at least one open side wherein each fiber directs moisture from the first side of the fabric material to the second side of the fabric material. A method for constructing the fabric material is also provided.

2 Claims, 1 Drawing Sheet

FABRIC MATERIAL CONSTRUCTED FROM OPEN-SIDED FIBERS FOR USE IN GARMENTS AND THE LIKE

BACKGROUND OF THE INVENTION

1. Field of the Invention

This invention relates generally to a fiber for constructing garments and the like and, more particularly, it relates to an open-sided fiber for constructing garments and the like which directs moisture away from the person wearing the garment and promotes rapid drying of the garment.

2. Description of the Prior Art

When a person is conducting and/or participating in strenuous activities, such as exercising, working, or participating in a sporting activity, the person tends to emit increased moisture from his or her body in the form of sweat. The garments worn by these persons during these activities naturally absorb the moisture. Without quick and proper drying of the fabric used to construct the garment, the moisture saturates the garment thereby substantially increasing the weight of the garment and presenting a potentially dangerous problem for the person in keeping his or her body and equipment warm and dry, especially in cold weather environments since if the moisture does not evaporate quickly, the user's body core temperature drops potentially leading to hypothermia and even death.

In the past, garments constructed from a particular fabric, i.e., COOLMAX™, E. I. duPont de Nemours and Company, were designed to direct the moisture away from the person's body when used in these types of activities. As the person emits moisture, the conventional fabric of these garments directs the moisture away from the person's body thereby keeping the person in a substantially dry state. Unfortunately, due to the construction of the conventional fabrics, the moisture is collected within and on the outside of the garment thereby increasing the weight of the garment and impeding the fabric of the garment from transporting additional moisture away from the person.

Accordingly, there exists a need for a garment which directs moisture away from a person and promotes quick drying of the garment. Additionally, a need exists for a garment constructed from a specially constructed fabric which directs moisture away from a person and promotes quick drying of the garment. Furthermore, there exists a need for a fabric constructed from fibers having an open-sided configuration, used alone or together with other types of fibers, which directs moisture away from a person and promotes quick drying of the garment.

SUMMARY

The present invention is a fabric material for forming a garment to be worn by a user. The fabric material has a first side and a second side. The fabric material comprises a plurality of fibers with at least a portion of the fibers having at least one open side wherein each fiber directs moisture from the first side of the fabric material to the second side of the fabric material thereby moving the moisture away from the user.

The present invention additionally includes a method for constructing a fabric material with the fabric material formable into a garment to be worn by a person. The method comprises constructing a plurality of fibers, forming at least a portion of the fibers as open-sided fibers, and knitting the fibers together to form the fabric material.

The present invention further includes a garment to be worn by a user with the garment directing moisture in a direction generally away from the user. The garment comprises a fabric material having a plurality of fibers with each fiber being either a closed-sided fiber or an open-sided fiber.

DETAILED DESCRIPTION OF THE PREFERRED EMBODIMENTS

Figure 1:
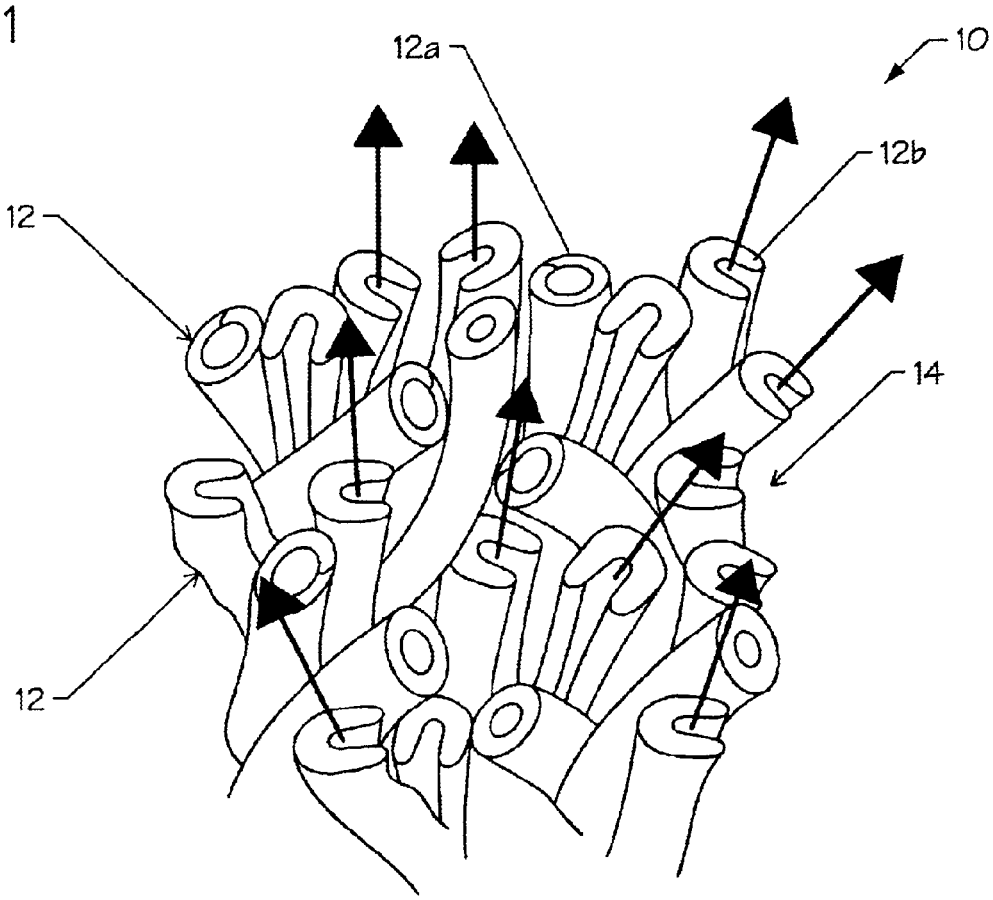
FIG. 1 is a front perspective view illustrating a portion of a fabric having open-sided fibers, constructed in accordance with the present invention.
Figure 2:
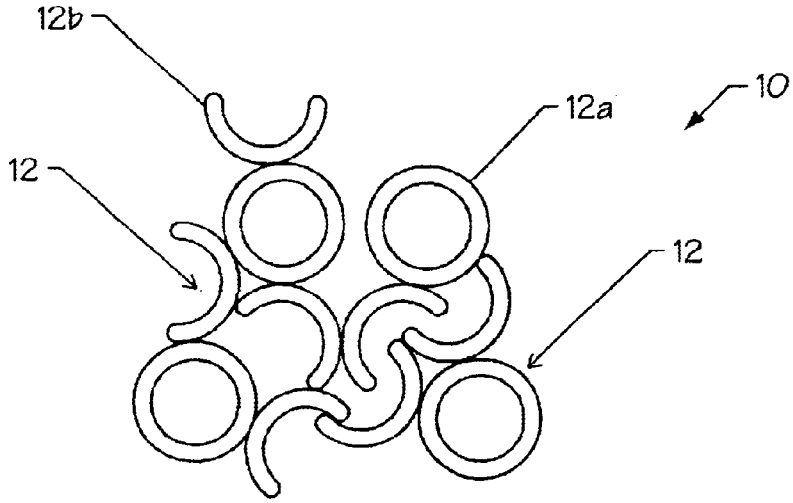
FIG. 2 is a sectional view illustrating the fabric having open-sided fibers of FIG. 1, constructed in accordance with the present invention.

As illustrated in FIGS. 1 and 2, the present invention is a fabric material, indicated generally at 10, constructed from a plurality of fibers 12, including closed-sided fibers 12*a* and open-sided fibers 12*b* for use in constructing garments 14 and the like. The garments 14 made from the fabric material 10 of the present invention can be any type of garment 14 typically worn by a user during exercising, working, or participating in a sporting activity such as shirts, pants, shorts, socks, sports bras, etc. Furthermore, it is within the scope of the present invention to utilize the fabric material 10 of the present invention to construct any type of item typically constructed from a fabric material 10, in addition to garments 14.

Since a wet person loses valuable body heat at a much faster rate than a dry person and a wet garment impedes removal of additional moisture from the user, directing moisture away from the fabric material 10 and quickly drying the moisture collected on the fabric material 10 allowing more moisture to be directed away from the user's body is extremely important to the user. The fabric material 10 of the present invention accomplishes these important requirements by directing moisture away from the person and promoting quick drying of the fabric material 10. Actual construction of the fabric material 10 to maximize movement of the moisture away from the user while minimizing drying time of the fabric material 10 will now be discussed in detail.

As mentioned briefly above, the fabric material 10 of the present invention is constructed from a plurality of fibers 12, both the closed-sided fibers 12*a* and the open-sided fibers 12*b*. As illustrated in FIGS. 1 and 2, the closed-sided fibers 12*a* are substantially tubular having a substantially circular cross-sectional configuration and the open-sided fibers 12*b* have a substantially C-shaped cross-sectional configuration. As the user wearing the fabric material 10 sweats or otherwise emits moisture, the moisture will travel from the user through the tubular closed-sided fibers 12*a* and the C-shaped open-sided fibers 12*b* in a direction generally away from the user.

By constructing the fabric material 10 from both the closed-sided fibers 12*a* and open-sided fibers 12*b*, the resulting garment 14 is sufficiently durable for use in many desired activities. It should be noted, however, that while the fabric material 10 has been heretofore and will be hereafter described as being constructed from both the closed-sided fibers 12*a* and the open-sided fibers 12*b*, it is within the scope of the present invention to construct the fabric material 10 entirely from open-sided fibers 12*b*. As will be described in detail below, the open-sided fibers 12*b* provide the unique ability for the fabric material 10, and thus the garment 14, to dry quickly thereby allowing the fabric material to direct additional moisture away from the user's body.

The fibers 12, both the closed-sided fibers 12*a* and the open-sided fibers 12*b*, are preferably constructed from a polyester material to promote moisture removal from the user. It should be noted, however, that while the closed-sided fibers 12*a* and the open-sided fibers 12*b* have been described as being constructed from a polyester material, it is within the scope of the present invention to construct the fibers 12 from other materials which direct moisture away from the user's body.

The closed-sided fibers 12*a* and the open-sided fibers 12*b* preferably have a range of wall thicknesses which are appropriate for constructing a garment 14 from the fabric material 10. The actual wall thickness of the closed-sided fibers 12*a* and the open-sided fibers 12*b* depends on the use of the garment 14, the weight of the garment 14, and the desires of the user.

Since the fabric material 10 of the present invention is preferably used to construct garments 14 having some degree of stretch, knitting the fibers 12 together is the preferred construction method. Basically, knitting is the interloping of fibers 12 to construct the fabric material 10. The fabric material 10 of the present invention with the closed-sided fibers 12*a* and the open-sided fibers 12*b* is preferably constructed from a warp knit knitting method. Basically, the fibers 12 run down the length of the fabric material 10 and zigzag across each other to form the fabric material 10. Each stitch in a course is made by a different fiber 12, either closed-sided or open-sided, feeding from a sheet of fibers (not shown) wound on a beam (not shown). Various forms of warp knits include, but are not muted to, tricot knit and raschel knit. The fabric material 10 can then be cut, shaped, and formed into a garment 14 or the like to be worn by a user.

When constructed, the fabric material 10 has an inside surface and an outside surface. Due to the construction of the fabric material 10 with the warp knit knitting method, with both the closed-sided fibers 12*a* and the open-sided fibers 12*b*, a person skilled in the art will understand that at least a portion of the open-sided fibers 12*b* will be exposed to air on the outside surface of the fabric material 10. As any moisture flows from the inside surface of the fabric material 10 adjacent the user's body, to the outside surface of the fabric material 10, the moisture captured within the open-sided fibers 12*b* will be exposed to air thereby promoting quicker drying of the moisture within the open-sided fibers 12*b* of the fabric material 10.

It should be noted that while the fabric material 10 of the present invention has been described as transporting moisture from an inside surface of the fabric material 10 to the outside surface of the fabric material 10, the fabric material 10 of the present invention can also transport moisture from the outside surface of the fabric material 10 to the inside surface of the fabric material 10. In other words, any garment 14 utilizing the fabric material 10 can be reversed and still maintain the beneficial features of the present invention of transporting moisture away from the body of the user.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A fabric material for forming a garment to be worn by a user, the fabric material having a first side and a second side, the fabric material comprising:

a plurality of fibers, at least a portion of the fibers having at least one exposed hollow fiber;

wherein the exposed hollow fibers have a substantially C-shaped cross-sectional configuration; and wherein each fiber directs moisture from the first side of the fabric material to the second side of the fabric material.

2. A garment to be worn by a user, the garment directing moisture in a direction generally away from the user, the garment comprising:

a fabric material having a plurality of fibers, each fiber being either a closed-sided fiber or an open-sided fiber, the open-sided fibers having a substantially C-shaped cross-sectional configuration.

* * * * *